US006014871A

United States Patent [19]

Romano

[11] Patent Number: 6,014,871

[45] Date of Patent: Jan. 18, 2000

[54] JEWELRY SYSTEM

[76] Inventor: Teresa J. Romano, 68 W. 82 St. Apt. B, New York, N.Y. 10024

[21] Appl. No.: 09/030,473

[22] Filed: Feb. 25, 1998

Related U.S. Application Data

[60] Provisional application No. 60/039,455, Feb. 25, 1997.

[51] Int. Cl.[7] ..... A44C 25/00

[52] U.S. Cl. ..... 63/41; 63/3.2; 63/1.11

[58] Field of Search ..... 63/41, 3.2, 3.1, 63/3, 4, 1.11, 1.16, 1.17

[56] References Cited

U.S. PATENT DOCUMENTS

| | | | |
|---|---|---|---|
| 27,264 | 2/1860 | Bissinger . | |
| 147,078 | 2/1874 | Stone . | |
| 468,677 | 2/1892 | Maxheimer et al. . | |
| 848,972 | 4/1907 | Costello . | |
| 1,441,999 | 1/1923 | Posner . | |
| 1,704,919 | 3/1929 | Murray | 63/3.2 |
| 1,807,293 | 5/1931 | Keller . | |
| 2,040,428 | 5/1936 | Candas | 63/1.16 |
| 2,084,151 | 6/1937 | Leitner | 63/3.1 |
| 2,228,686 | 1/1941 | Bezault . | |
| 2,462,425 | 2/1949 | Pratt et al. . | |
| 2,521,589 | 9/1950 | Livingston | 63/3.2 X |
| 2,529,058 | 11/1950 | Tell et al. | 63/3.2 X |
| 2,586,758 | 2/1952 | Zerr . | |
| 3,170,311 | 2/1965 | Raphael | 63/3.1 |
| 3,192,737 | 7/1965 | Schechter et al. . | |
| 3,208,238 | 9/1965 | Spitzer | 63/3.1 |
| 3,481,155 | 12/1969 | Cook | 63/3 |
| 4,237,702 | 12/1980 | Caverly . | |
| 4,426,854 | 1/1984 | Geldwerth et al. . | |
| 4,520,537 | 6/1985 | Valikov . | |
| 4,763,489 | 8/1988 | Strong . | |
| 4,881,305 | 11/1989 | Rivera . | |
| 5,231,740 | 8/1993 | Mohebkhosravi . | |
| 5,598,722 | 2/1997 | Leach, II et al. . | |

*Primary Examiner*—Terry Lee Melius
*Assistant Examiner*—William L. Miller
*Attorney, Agent, or Firm*—Anthony J. Casella; Gerald E. Hespos

[57] ABSTRACT

A jewelry system is provided including a necklace assembly having opposed ends that are connectable to one another by releasably lockable primary finding components. The necklace assembly further includes auxiliary findings that are unobtrusive and that enable portions of the necklace assembly to be disassembled. The disassembled portions may be reconfigured to form either a single our double-strand bracelet or for incorporation into a pin. The system further includes connectors for holding adjacent strands of a double-strand bracelet in substantially parallel relationship to one another. The system further includes at least one pin base for connection to portions of the disassembled necklace such that the combined pin base and portions of the necklace function as a pin.

10 Claims, 3 Drawing Sheets

JEWELRY SYSTEM

This application claims the benefit of Provisional Patent Appl. No. 60/039,455 which was filed on Feb. 25, 1997.

BACKGROUND OF THE INVENTION

1. Field of the Invention

The subject invention relates to a flexible length of jewelry having portions that can be selectively disconnected and reassembled to define different types of jewelry pieces.

2. Description of the Prior Art

Jewelry is manufactured in a wide range of different styles to match the personal preferences of the wearer and to coordinate with her clothing. Jewelry is also manufactured to be worn at different locations on the body to provide different types of accents in accordance with the personal preferences of the wearer. For example, a person may choose to wear a necklace, a bracelet, a pin, earrings or any combination of the above.

Some jewelry pieces emphasize a large stylish pendant that may be suspended around the neck from a gold chain. The gold chain typically is sufficiently thin to avoid detracting from the pendant. Some such pendants may be provided with a pin secured to the rear side. The thin gold chain may be removed, and the pendant may be worn as a broach that is pinned to clothing.

Other prior art jewelry consists primarily of a decorative chain. In particular, prior art bracelets and necklaces have been formed with stylish interconnected links that are aesthetically attractive independent of any pendant.

The individual links that comprise chains of this general type may be formed with clearly differentiated front and rear surfaces. The rear surface typically is substantially flat and unadorned. The front or top surface, however, emphasizes the aesthetic beauty of the jewelry. For example, the front or top surface may define a plurality of parallel members that are transversely or obliquely aligned to the axis of the chain. Some jewelry chains include precious or semi-precious gems mounted to the front face. For example, gems may be mounted between the parallel decorative members on the front face of the chain.

Decorative chain necklaces typically are formed as a single strand. Decorative chain bracelets also may be formed as a single strand. However, many decorative chain bracelets are formed as two parallel adjacent strands. The adjacent strands of the bracelet are connected to one another at spaced apart locations to ensure that these respective strands present the visual appearance of a single strand.

Prior art bracelets typically are sufficiently long to fit comfortably around the wrist of the wearer, but are sufficiently short to prevent the bracelet from sliding off over the hand. Similarly, most prior art necklaces are dimensioned to be draped comfortably around the neck of the wearer. However, most are too short to be slid over the head of the wearer. Thus, both necklaces and bracelets are provided with clasps or findings that enable the elongate necklace or bracelet to be securely retained in a loop around the wrist or neck of the wearer. Findings must be configured and dimensioned to facilitate digital manipulation during clasping and unclasping. Additionally, the locking elements of a finding must be positioned at locations where they can be readily accessed for digital manipulation. These size requirements of findings virtually preclude an unobtrusive finding. Consequently, most jewelers design findings that are visually attractive in their own right. For example, findings may be designed to coordinate with the links in the chain bracelet or necklace. Other jewelers use a single finding design for virtually all jewelry, such that the finding effectively functions as a trademark. The locking elements of the prior art finding must be positioned at a location that can be easily accessed. Thus, the locking elements typically are disposed on the respective sides or the top of the jewelry piece. In other instances, the locking elements are constructed to be accessible from the top surface of the decorative chain.

Most women wear several pieces of jewelry simultaneously. The respective jewelry pieces should match or coordinate with one another. Thus, for example, a woman may wear a coordinating pin and bracelet. Additionally, most women select a jewelry piece because they find the jewelry design attractive and well-suited for their taste in clothing. Thus, a woman may have a few favorite pieces of jewelry that will be worn very frequently.

The prior art has included inexpensive costume jewelry typically formed from a plurality of plastic pieces that can be releasably snapped into engagement with one another. For example, a sufficient number of plastic pieces may be snapped together to form a bracelet. A larger number of plastic pieces may be snapped together to form a necklace. The individual pieces in such costume jewelry typically have been spherical and have been colored to resemble pearls. Prior art costume jewelry of this type typically has not included separate clasps or findings and has not included connecting structures to produce anything other than a single strand necklace or a single strand bracelet.

In view of the above, it is an object of the subject invention to provide a jewelry system that enables greater versatility and utility from a single piece of high quality jewelry.

SUMMARY OF THE INVENTION

The subject invention is directed to a jewelry system that comprises a decorative chain. The decorative chain includes a plurality of interconnected links that are hinged or articulated relative to one another. Each link may include a bottom or rear surface and a top or front surface having decorative portions of the link. Side surfaces may extend between the top and bottom surfaces. The mechanical interconnection between adjacent links may be closer to the rear surface, and may permit pivoting or articulation about plural axes.

The decorative chain may include opposed longitudinal ends having mateable portions of a primary finding which also has opposed top and bottom surfaces and opposed side surfaces. Locking portions of the primary finding may be digitally accessible from the top surface of the primary finding or along opposed sides thereof. The finding enables opposed longitudinal ends of the decorative chain to be releasably locked together around the neck of the wearer to form a single strand necklace. Portions of the necklace disposed approximately centrally between the opposed ends may be interconnected in substantially side-to-side relationship. Thus, the central portions of the necklace may define a point directed downwardly approximately in line with the front portion of the wearer's neck.

The decorative chain may further include a plurality of unobtrusive auxiliary findings that are accessible only from the back or rear surface of the decorative chain. These unobtrusive auxiliary findings are constructed to permit very secure interconnection, while also enabling disconnection at times when the rear surface of the decorative chain is accessible. Typically, these times will occur when the decorative chain is not being worn.

At least one unobtrusive auxiliary finding may be disposed at or near the midpoint of the decorative chain. For example, in a preferred embodiment described further herein, the decorative chain may include two auxiliary findings disposed in slightly spaced relationship to portions of the decorative chain that are connected in side-to-side relationship.

The auxiliary finding may be disconnected to enable the long decorative chain to be separated into at least two shorter chains. In the preferred embodiment, both auxiliary findings may be disconnected to enable the long decorative chain to be divided into two intermediate length decorative chains and a pair of very short chain sections that are permanently interconnected to one another in side-to-side relationship.

At least one and preferably two of the intermediate length sections produced by disconnecting the auxiliary finding may be used to form at least one bracelet. The system may further include at least one chain connector or accessory for releasably holding a pair of intermediate length sections in approximately parallel side-to-side relationship. The findings then may be used to releasably secure these short parallel connected chain sections around the wrist of the wearer to produce a double-stranded bracelet. The connectors or accessories for interconnecting these short chain sections may be decorative in their own right. For example, the double-strand connectors may be formed to resemble gold knots or any other aesthetically attractive shape. In some embodiments the connectors or accessories may include decorative dangling portions or pendants. In other embodiments, the bracelet accessories may be dimensioned and configured to mount to a single strand bracelet.

The system may further include a pin for secure but releasable locking to a portion of the decorative chain. For example, the pin may be releasably secured to the short parallel chain sections that are permanently secured in side-to-side relationship and that define the midpoint of a necklace. Thus, in this manner the pin functions as a decorative pendant on the necklace. The pin also may be releasably attached to an article of clothing independent of any other part of the jewelry system. Alternatively, the pin may be releasably connected to short sections of the chain, and the assembly of the pin and chain may be attached to an article of clothing.

The decorative chain described above enables the owner to have a very attractive gold chain necklace. The necklace includes the primary finding comprising interconnectable members disposed at the opposed ends of the chain. Locking portions on the primary finding are disposed and may be accessible at the top surface of the finding or the opposed sides of the finding. The necklace further includes at least one and preferably two unobtrusive auxiliary findings disposed at or near the midpoint of the chain. The auxiliary findings are disposed on and are accessible from the bottom surface of the decorative chain. Thus, the auxiliary findings have virtually no visual effect on the aesthetics of the decorative chain, when the decorative chain is used as a necklace. However, upon removal of the necklace, the decorative chain can be positioned with its bottom or rear surface accessible to enable opening of the auxiliary findings. Thus, the long decorative chain necklace can be divided into a single strand bracelet and at least one additional jewelry component. Decorative accessories, such as pendants may be attached to the single strand bracelet. The additional jewelry component may also include a second strand, and the system may include bracelet connectors for bridging the two respective strands and for releasably holding the respective strands at a plurality of spaced apart locations to form a double-stranded bracelet. The remaining portion of the original strand may be releasably connected to a pin to enable a matching pin and bracelet to be worn simultaneously.

DETAILED DESCRIPTION OF THE PREFERRED EMBODIMENT

Figure 1:
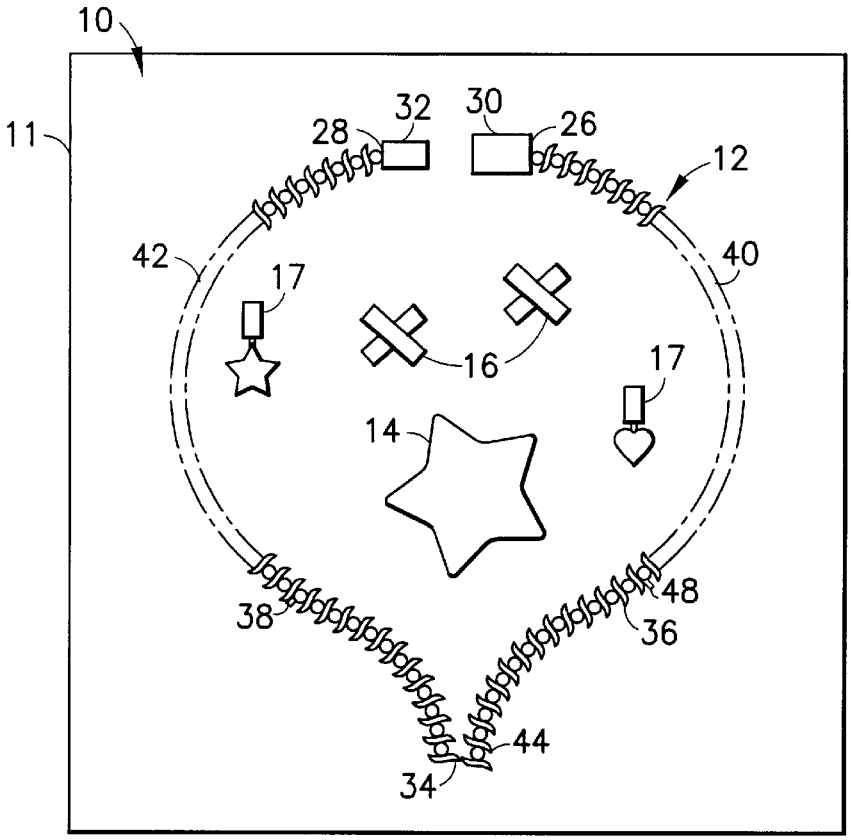
FIG. 1 is a top plan view of a display package including each of the respective components of the system in accordance with the subject invention.

A jewelry system in accordance with the subject invention is identified generally by the numeral 10 in FIG. 1. The jewelry system depicted in FIG. 1 is packaged in a display case 11 having a plurality of recesses formed to receive the respective components of the system as described herein. The system 10 includes a necklace assembly 12, a pin 14, a plurality of double strand connectors 16 and a plurality of single strand accessories. Two double strand connectors 16 and two single strand accessories 17 are depicted in FIG. 1. However, more than two double strand connectors 16 and more than two single strand accessories 17 may be provided.

Figure 3:
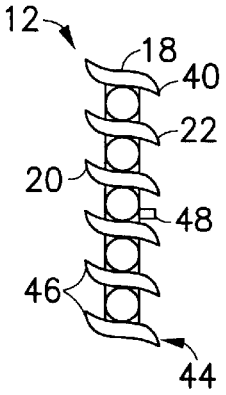
FIG. 3 is a top plan view of a portion of the decorative chain in proximity to a secondary finding.
Figure 4:
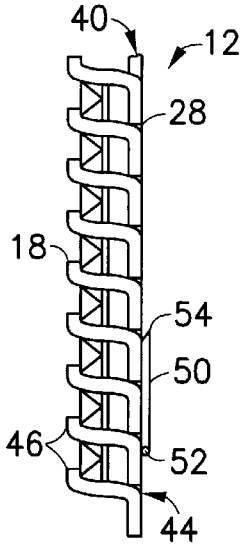
FIG. 4 is a side elevational view of the portion of the decorative chain shown in FIG. 3.
Figure 5:
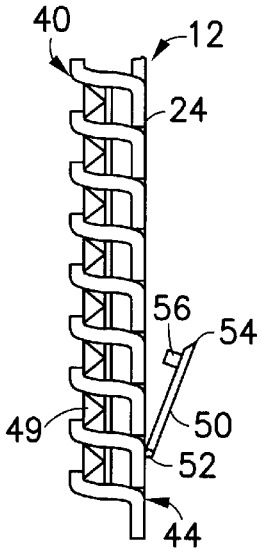
FIG. 5 is a side elevational view similar to FIG. 4, but showing the latch of the secondary finding in an opened condition.

The necklace assembly 12 is formed as a decorative chain having a top surface 18, a first side surface 20, a second side surface 22 and a bottom surface 24 as shown most clearly in FIGS. 3–5. The bottom surface 24 is sufficiently broad between the first and second sides 20 and 22 of the necklace assembly 12 to ensure that the bottom surface 24 will seat comfortably against the skin of the wearer. The top surface 18 may take any of several different decorative forms as discussed further herein.

Returning to FIG. 1, the necklace assembly 12 includes opposed first and second ends 26 and 28. A first primary finding component 30 is mounted to the first end of the necklace assembly 12, and a second primary finding component 32 is mounted to the second end 28 thereof. The first and second primary finding components 30 and 32 are releasably lockable to permit secure retention of the necklace assembly 12 around the neck of the wearer. The first and second primary finding components 30 and 32 may be of prior art construction. More particularly, the first and second primary finding components 30 and 32 may be disposed and configured to permit easy digital manipulation during locking and unlocking. Additionally, the first and second primary finding components 30 and 32 may include at least one latch element that is accessible from the top 18 of the decorative chain forming the necklace assembly 12 or from at least one of the first and second side 20 or 22 thereof. The disposition of the latch elements of the primary finding components 30 and 32 may be entirely conventional and preferably is selected to enable the digital manipulation required to connect or disconnect the first and second components 30 and 32 of the primary finding.

Portions of the necklace assembly 12 approximately equidistant from the first and second ends 26 and 28 are permanently joined in substantially side-to-side relationship to define a point 34. More particularly, inwardly facing sides 22 of the decorative chain forming the necklace assembly 16 are securely affixed in side-to-side relationship with one another to cause the necklace assembly to define the point 34 for decorative purposes. In other embodiments, the necklace assembly 12 may define a continuous loop without a connection comparable to the point 34 shown in FIG. 1.

The necklace assembly 12 includes a first auxiliary finding assembly 36 between point 34 and the first end 26 of the necklace assembly 12. Additionally, the necklace assembly 12 includes a second auxiliary finding assembly 38 between the point 34 and the second end 28 of the necklace assembly 16. The first and second auxiliary finding assemblies 36 and 38 are significantly closer to the point 34 than to the respective first and second ends 26 and 28 of the necklace assembly 16. The auxiliary finding assemblies 36 and 38 each are dimensioned and configured to be substantially visually unobtrusive from the top view as depicted in FIG. 1 and from either side. However, the auxiliary finding assemblies 36 and 38 can be securely locked and selectively disengaged. Disengagement of the respective auxiliary finding assemblies 36 and 38 enable the necklace assembly 12 to be separated into a first bracelet component 40, a second bracelet component 42 and a pin component 44. The first bracelet component 40 extends from the first primary finding component 30 to the first auxiliary finding 36. The second bracelet component 42 extends from the second primary finding component 32 to the second auxiliary finding 38. The pin component 44 extends from the point 34 to the first and second auxiliary findings 36 and 38.

As shown in FIGS. 3–7, necklace assembly 12 is formed as a decorative chain having a plurality of hingedly connected links 46. Each link may be pivoted relative to the adjacent link about an axis extending orthogonally between the first and second sides 20 and 22 of the decorative chain. Additionally, each link 46 may be pivoted relative to each adjacent link about an axis extending orthogonally between the top surface 18 and the bottom surface 24. This ability to pivot about perpendicular axes enables the chain to adapt the shape of the wearer and to rest comfortably on the skin near the neck and shoulders.

Figure 6:
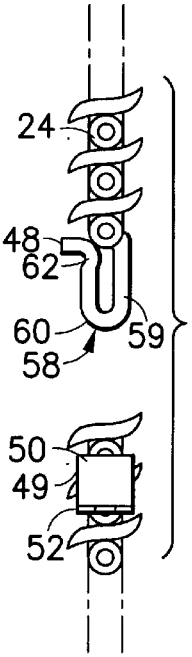
FIG. 6 is a bottom plan view with the section of decorative chain shown in FIGS. 2–4, but in a separated condition.
Figure 7:
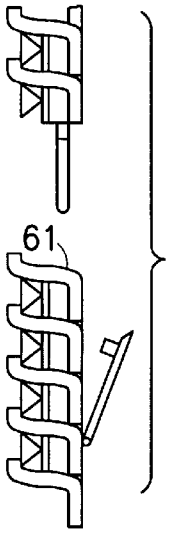
FIG. 7 is a side elevational view of the disconnected secondary finding as shown in FIG. 6.

As shown most clearly in FIGS. 4–6, the bottom surface 24 of the decorative chain is wide and flat to define a base for resting against the skin. This configuration ensures that the decorative top surface 18 of the chain will face away from the skin for maximizing the aesthetic beauty of the decorative chain. As shown most clearly in FIG. 3, the top surface 18 of the decorative chain includes a repetitive pattern of aesthetically attractive elements. In particular, the embodiment shown herein includes a repetitive pattern of S-shaped gold members arranged substantially parallel to one another and generally transverse to the axis of the chair. Diamonds or other gems are securely affixed to the respective lengths of the decorative chain between the S-shaped formations shown in FIG. 3.

As shown most clearly in FIG. 3, the auxiliary finding 36 is substantially unobtrusive when viewed from the top of the necklace assembly 12. In particular, a very small projection 48 extends slightly transversely from the side 20 of the decorative chain. As depicted in FIGS. 4–7, the auxiliary finding 36 includes a female component 49 having a latch 50 hingedly connected thereto. The female component 49 has a front surface that is substantially identical to the front surface of any link 46. The latch 50 rotates about a hinge pin 52 substantially adjacent the rear surface 24. The hinge pin 52 extends parallel to the rear surface 24 and orthogonally between the opposed sides 20 and 22. The end 54 of the latch 50 remote from the hinge pin 52 is configured to enable digital manipulation by a fingernail. Digital forces exerted by a fingernail will permit rotation of the latch 50 about the hinge pin 52. As shown most clearly in FIG. 5, portions of the latch 50 near the end 54 and facing the bottom surface 24 includes a locking projection 56.

As shown in FIG. 6, the auxiliary finding 36 further includes a male component in the form of a U-shaped spring 58 having parallel arms 59 and 60. The projection 48 is on the arm 60. The spring 58 is configured to be slidably inserted into a slot 61 formed in the female component 49 of the auxiliary finding 36 to which the latch 50 is hinged. The slot 61 is dimensioned to require the U-shaped spring 58 to resiliently deflect during connection. This resilient deflection causes the arm 60 with the projection 48 thereon to move inwardly toward the arm 59. After sufficient insertion of the U-shaped spring 58 into the slot 61, a notch 62 formed adjacent the projection 48 will align with a corresponding rigid post adjacent the slot 61. The spring member 58 will then resilient return toward an undeflected condition such that the notch 62 is biased toward the post adjacent the slot 61. The latch 50 then can be rotated about the hinge pin 52 and toward the bottom surface 24 such that the projection 56 is snapped into engagement between the opposed arms of the U-shaped spring 58. The post 56 thus prevents the inward deflection of the arms 59 and 60 of the U-shaped spring 58, and thereby prevents unintended separation of the auxiliary finding 36.

The auxiliary finding can be disconnected by inserting sufficient force on end 54 of latch 50 to separate the post 56 from the U-shaped spring 58. The projection 48 then can be urged laterally to disengage the notch 62 of the U-shaped spring 58 from the corresponding support adjacent slot 60. The opposed halves of the auxiliary finding 36 can then be separated into the condition shown in FIGS. 6 and 7. The reverse process can be carried out for connecting the auxiliary finding. The auxiliary findings may take forms other than those depicted in FIGS. 4–7. For example, one end of a bracelet component 40 or 42 may include a hinged member that may be hinged around a hook on the opposed end of the bracelet component 40 or 42 and releasably snapped into engagement with itself. Preferably, all such embodiments of the auxiliary finding are visually unobtrusive.

All parts of the auxiliary findings 36 or 38, except for the projection 48, define a width no greater than the width of a decorative chain defined by the opposed sides 20 and 22. If desired, the primary findings may be of the same construction.

Figure 2:
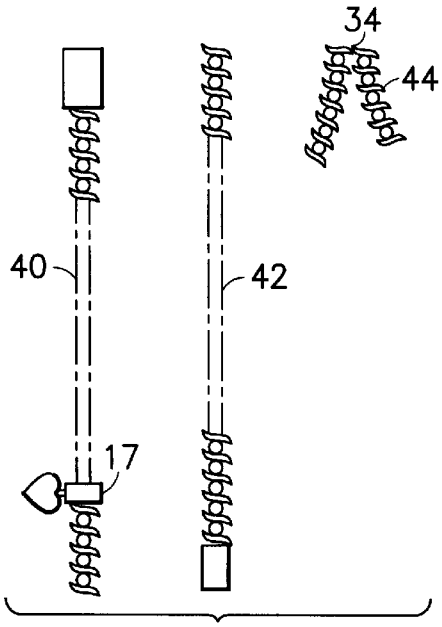
FIG. 2 is a top plan view of the decorative chain in a fully disconnected condition.
Figure 8:
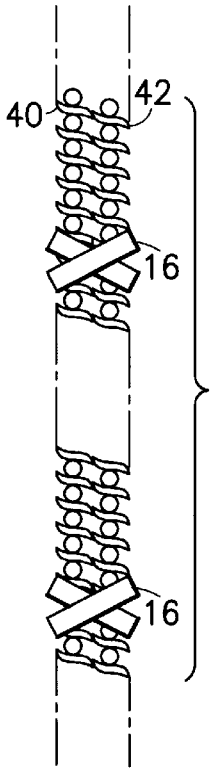
FIG. 8 is a top plan view of the bracelet sections joined by a plurality of connectors to form a double-stranded bracelet.
Figure 9:
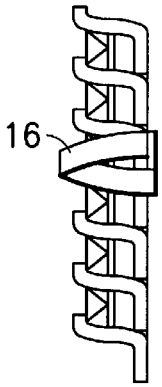
FIG. 9 is a side elevational view of the bracelet shown in FIG. 8.
Figure 10:
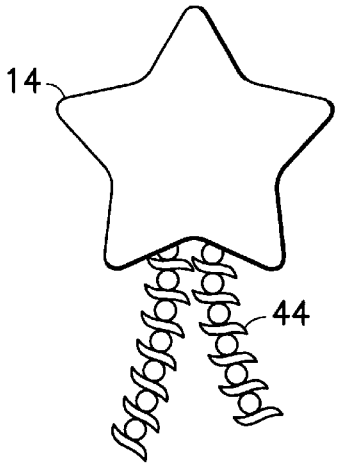
FIG. 10 is a top plan view of a pin formed with the pin base and the pin segments of the system shown in FIG. 1.
Figure 11:
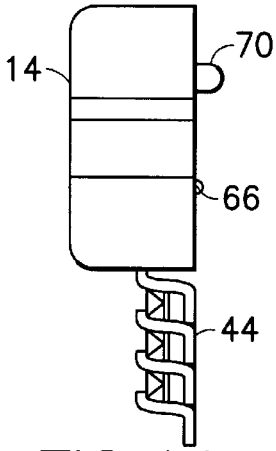
FIG. 11 is a side elevational view of the pin shown in FIG. 10.
Figure 12:
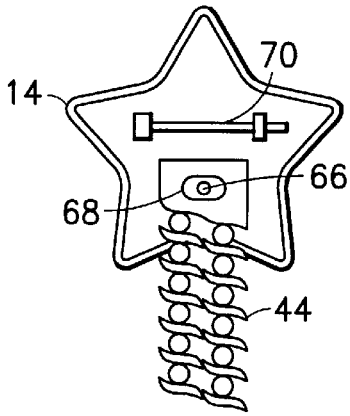
FIG. 12 is a bottom plan view of the pin.

The necklace assembly 12 can be disconnected at the auxiliary findings 36 and 38 to form the first and second bracelet components 40 and 42 and the pin component 44 as shown in FIG. 2. The first and second bracelet components can be connected to one another by connectors 16, as shown in FIG. 8, to form a double-strand bracelet. The connectors 16 include connector findings 64, as shown in FIG. 9 to releasably hold each connector 16 in place and to hold the first and second bracelet components 40 and 42 in approximately parallel side-to-side relationship with one another. As depicted in FIGS. 1 and 8, the connectors 16 are configured to resemble a small ribbon wrapped around the adjacent bracelet components 40 and 42. However, other connector designs may be employed.

The single strand accessories 17 include findings identical or similar to those described above. However, the findings of the single strand accessories are dimensioned to engage around only a single bracelet component 40 or 42. Further, in the embodiments depicted herein, the single strand accessories 17 include pendants. Decorative single strand accessories with other pendant designs or with no pendants may be provided.

The pin component 44 may be used with the pin base 14 as shown in FIGS. 1 and 10–12. The pin base 14 includes a post 66 that can be urged between adjacent permanently connected links on the pin component 44. The post 66 then may be secured in this position by a spring connector 68. A safety pin 70 is mounted to the rear face of the pin base 14 to permit secure but releasable attachment of the pin base 14 and the pin component 44 depending therefrom onto an appropriate location on the woman's clothing. Alternatively, the pin base 14 may be worn separately from the pin component 44 or may be attached to the pin component 44 when the pin component 44 is part of the necklace 16. As shown herein, the pin base 14 is decoratively configured as a star, and the adjacent short lengths of decorative chain that comprise the pin component 44 extend from the star as if depicting rays of light. In this regard, the gems and the gold forming the decorative chain will reflect light in much the manner as a star.

While the invention has been described with respect to a preferred embodiment, it is apparent that changes can be made without departing from the scope of the invention as defined by the appended claims. In particular, decorative chains with front surfaces of many other configurations may be provided. Similarly, connectors and pin bases of other shapes may be provided. Still further, primary findings of other constructions may be mounted to the opposed ends of the necklace assembly. In still other embodiments, additional auxiliary findings may be provided and earring bases may be incorporated into the system. Thus, additional lengths of the necklace assembly may be attached to earring bases to further expand the options available with the subject system. These and other changes will be apparent to a person skilled in this art after having read this specification.

What is claimed is:

1. A jewelry system comprising a necklace assembly having a decorative chain with opposed first and second ends, releasably lockable primary finding components mounted to the opposed first and second ends of the necklace assembly, first and second auxiliary findings being mounted to said necklace assembly intermediate said opposed first and second ends of said necklace, said first and second auxiliary findings including mateable components releasably locked with one another for permitting portions of said necklace assembly to be disconnected from remaining portions of said necklace assembly for use as a bracelet, portions of said necklace assembly between said first end and said first auxiliary finding defining a first bracelet component, portions of said necklace assembly from said second end to said second auxiliary finding defining a second bracelet component, portions of said necklace assembly between said first and second auxiliary findings forming a pin component, said system further including at least one connector for releasably joining said first and second bracelet components in substantially parallel side-to-side relationship for forming a double-stranded bracelet, said system further comprising a pin base releasably engageable with said pin component and having pin means for releasable connection of said pin base to an item of clothing.

2. The system of claim 1, wherein said decorative chain has a rear surface, an opposed front surface, and a pair of sides, said primary finding including a locking element accessible from at least one surface selected from the group consisting from said side surfaces and said, front surface of said necklace assembly, said auxiliary finding including a latch element accessible from said rear surface of said necklace assembly.

3. The system as in claim 2, wherein the primary finding defines a width greater than the width of said decorative chain, and wherein the auxiliary finding defines a width substantially equal to the width of the decorative chain.

4. A jewelry system comprising an elongate decorative chain with opposed first and second ends, portions of said decorative chain between said ends having opposed front and rear surfaces defining a height for said decorative chain and having opposed sides defining a width for said decorative chain, first and second primary finding components mounted respectively to the first and second ends of the decorative chain and being releasably lockable with one another, said system further comprising at least one auxiliary finding assembly intermediate said ends of said decorative chain, said auxiliary finding assembly comprising a female finding component having a height and a width substantially equal to the height and the width of the decorative chain and having a receptacle formed therein, a male finding component configured for releasable locked engagement in the receptacle of the female finding component, and a latch hingedly connected to the rear surface of the decorative chain for hinged movement about an axis extending between said sides, said latch defining a width no greater than the width of the decorative chain and being releasably engageable with portions of said rear surface of said decorative chain registered with said engaged male and female finding components, whereby said auxiliary finding components enable reconfiguration of portions of said decorative chain for selectively shortening and lengthening said decorative chain.

5. The system of claim 4, wherein the system comprises at least two of said auxiliary finding assemblies.

6. The system of claim 4, further comprising at least one connector for releasably connecting portions of said decorative chain in side-to-side engagement with one another.

7. The system of claim 6, wherein at least one said connector includes a pin mounted thereto for pinning said connector and portions of said decorative chain connected thereto onto an item of clothing.

8. The system of claim 4, wherein said latch includes a projection at an end thereof remote from the hinged connection of said latch to said rear surface of said decorative chain, and wherein portions of said decorative chain in proximity to said male finding component define an opening for releasable locked engagement with said projection on said latch.

9. The system of claim 8, wherein portions of said latch remote from said hinged connection of said latch to said rear surface of said decorative chain are tapered for insertion of a finger nail between said latch and said decorative chain thereby releasing said projection of said latch from said decorative chain.

10. The system of claim 4, further comprising at least one accessory having a lockable portion for releasable locked connection to a selected location on said decorative chain and having a pendant suspended from said lockable portion.

* * * * *